United States Patent [19]

Kamp et al.

[11] 4,139,108

[45] Feb. 13, 1979

[54] MAGAZINE ASSEMBLY FOR COIL CORES OR TUBES

[75] Inventors: Heinz Kamp, Rickelrath; Hans Raasch, Mönchen-Gladbach, both of Fed. Rep. of Germany

[73] Assignee: W. Schlafhorst & Co., Mönchen-Gladbach, Fed. Rep. of Germany

[21] Appl. No.: 858,281

[22] Filed: Nov. 28, 1977

Related U.S. Application Data

[63] Continuation of Ser. No. 699,846, Jun. 25, 1976, abandoned.

[30] Foreign Application Priority Data

Jun. 25, 1975 [DE] Fed. Rep. of Germany ..... 2528222

[51] Int. Cl.[2] ..... B65G 67/04

[52] U.S. Cl. ..... 214/41 R; 198/429; 198/469; 198/485; 198/597; 198/747; 214/83.3; 242/35.5 A

[58] Field of Search ..... 198/429, 469, 485, 486, 198/572, 597, 719, 736, 747, 774, 339; 57/55; 242/35.5 A, 18 R; 214/41 R, 44 R, 83.3

[56] References Cited

U.S. PATENT DOCUMENTS

| | | | |
|---|---|---|---|
| 3,554,363 | 1/1971 | Elineau | 198/774 |
| 3,722,662 | 3/1973 | Wakabayashi et al. | 198/486 |
| 3,811,631 | 5/1974 | Mayer et al. | 242/18 R |
| 3,815,726 | 6/1974 | Klein | 198/774 |

FOREIGN PATENT DOCUMENTS

| | | | |
|---|---|---|---|
| 31256 | 10/1970 | Japan | 242/35.5 X |
| 938839 | 10/1963 | United Kingdom | 242/35.5 A |

*Primary Examiner*—Joseph E. Valenza
*Attorney, Agent, or Firm*—Herbert L. Lerner

[57] ABSTRACT

Coil core magazine assembly for conical or cylindrical coil cores disposed mutually adjacent one another includes a coil core magazine, means for loading the magazine with coil cores, and means for removing coil cores from the magazine, the magazine having a plurality of axially parallel coil core holders disposed in a given plane and loadable with coil cores in axial direction of the coil cores, and a coil core feeding device operatively connected to the coil core holders for feeding the coil cores loaded in the coil core holders to the coil core removing means in a direction transverse to the axial direction of the coil cores.

5 Claims, 4 Drawing Figures

MAGAZINE ASSEMBLY FOR COIL CORES OR TUBES

Figure 1:
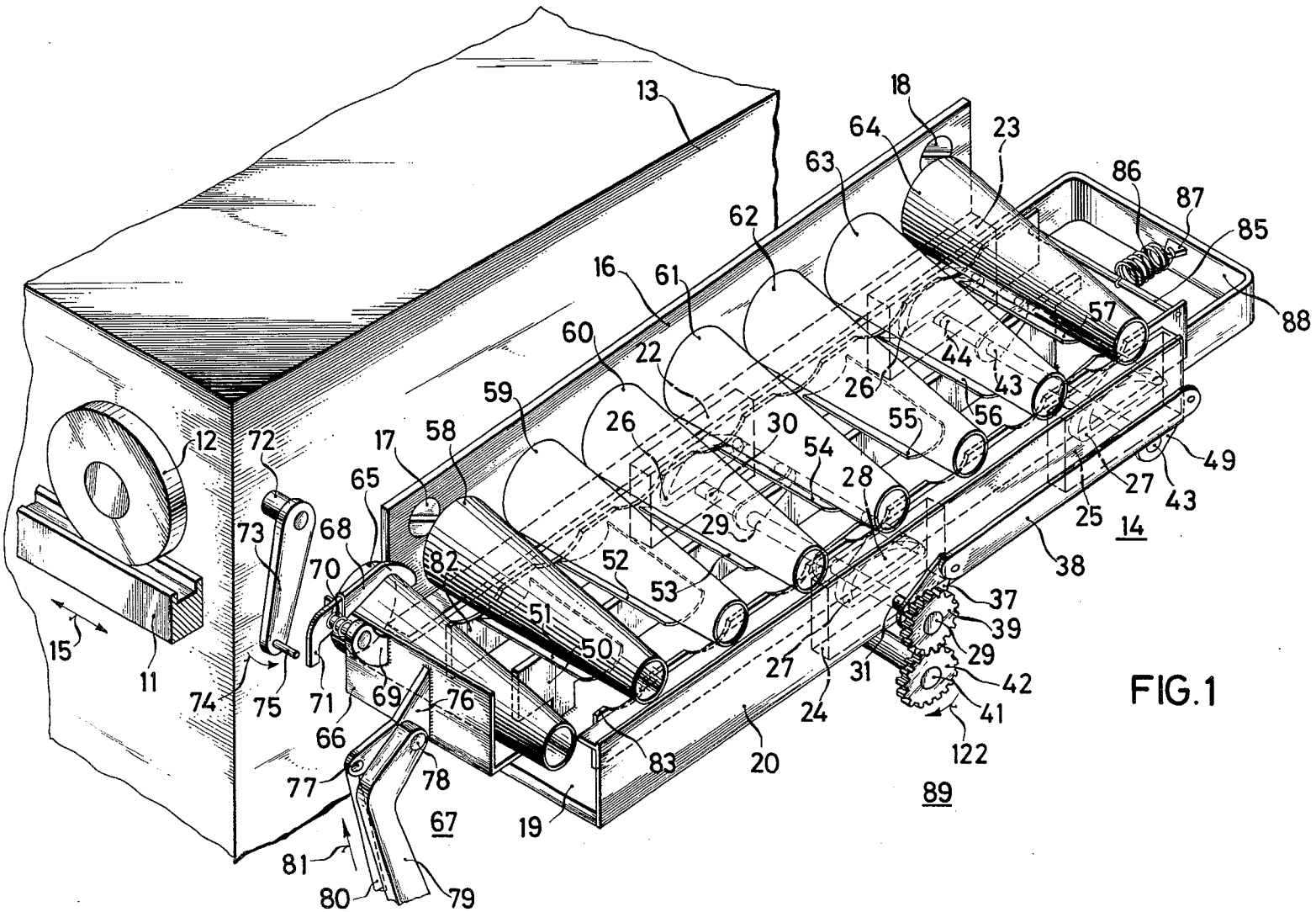

This is a continuation, of application Ser. No. 699,846, filed June 25, 1976, now abandoned.

The invention relates to a coil core or tube magazine assembly for coil cores or bobbin tubes that are disposed mutually adjacent one another and include a coil core magazine, a coil core loading device and a coil core removing device, especially for a travelling bobbin or coil exchanger of a textile machine.

Travelling coil exchangers are used, for example, in winding machines. Since winding machines can selectively wind cylindrical and conical bobbins, it has heretofore been considered advantageous to assign a magazine for empty or unwound coil cores or bobbin tubes to every winding station, the magazine being installed to receive either conical or cylindrical bobbin tubes or coil cores. Such magazines are generally disposed in a shaft-like manner. It is not possible to stack as many conical bobbin tubes or coil cores in such a magazine as one might desire, because the tubes or cores are not disposed parallel to one another. If conical bobbin tubes or coil cores are laid side by side, a curved tube or core packet is obtained, which renders the removal and replenishment of the bobbin tubes or coil cores more difficult. The number of bobbin tubes or coil cores that can be stored is therefore limited to only a few pieces.

For these reasons, there has heretofore been a practice of avoiding the provision of a supply of bobbin tubes or coil cores to the bobbin or coil exchanger per se.

It is an object of the invention to provide a magazine assembly for coil cores or tubes which simplifies the storage of the bobbin tubes or coil cores in a textile machine and which renders it possible to install a magazine for a sufficiently large number of bobbin tubes or coil cores, especially in a travelling bobbin or coil exchanger.

With the foregoing and other objects in view, there is provided, in accordance with the invention, a coil core magazine assembly for conical or cylindrical coil cores disposed mutually adjacent one another, comprising a coil core magazine, means for loading the magazine with coil cores, and means for removing coil cores from the magazine, the magazine having a plurality of axially parallel coil core holders disposed in a given plane and loadable with coil cores in axial direction of the coil cores, and a coil core feeding device operatively connected to the coil core holders for feeding the coil cores loaded in the coil core holders to the coil core removing means in a direction transverse to the axial direction of the coil cores. Each coil core or bobbin tube is thus mounted or held by itself. Difficulties that might arise during the transportation of the tubes or cores, in that the tubes or cores would become laid up against one another in an arcuate manner, are thereby avoided.

The instant the tube or core removing device is ready to remove a bobbin tube or coil core, the feeding device can become operative. Feeding can be effected, for example, by a conveyor belt. In accordance with another feature of the invention, the feeding device comprises a stepping mechanism including means for lifting the coil cores out of the respective coil core holders thereof and simultaneously transporting all of the coil cores, in direction toward the coil core removing means, through a division corresponding to one of the axially parallel coil core holders disposed in the given plane, and means for lowering the lifted and transported coil cores into the coil core removing means and the coil core holders, respectively. Assurance is thereby provided that the respective first bobbin tube or coil core of the supply thereof is made ready for the tube or core removing device always at the same location.

The bobbin or coil exchanger of a textile machine, for example, travels back and forth past the individual work stations, becomes operative upon demand at one or more working stations and returns to its starting position at one end of the travel path or track thereof. At the one end of the travel path or track of the bobbin or coil exchanger, a loading device for loading the tube or coil magazine with bobbin tubes or coil cores may be provided. Space is most likely available for such a loading device at the end of the travel path or track of the travelling bobbin or coil exchanger.

The tube or core magazine of the bobbin or coil exchanger may have a quite different extend of filling, before loading the new tubes or cores begins. To prevent overloading of the tube or core magazine, the loading means therefore comprises devices for determining the condition of fullness of the tube or coil core magazine and for loading coil cores into only those coil core holders that are vacant of any coil cores.

In accordance with an added feature of the invention, the coil core removing means comprises a coil core carrier swingable away from the coil core holders, and coil core gripper means for securing the respective coil core disposed in the coil core carrier from falling out of the coil core carrier.

The feeding of the bobbin tubes or coil cores is in axial direction of the tubes or cores. The tube or core axes are thus oriented in longitudinal direction of the textile machine. In a preferred embodiment of the loading means, as many tubes or cores are initially made ready as there are tube or core holders in the tube or core magazine. In accordance with a concomitant feature of the invention, therefore, the coil core loading means comprise plungers sprung in axial direction thereof for feeding the coil cores into the coil core magazine in axial direction of the coil cores.

The insertion of a new bobbin tube or coil core into a tube or core holder already occupied by a tube or core with simultaneous ejection of the bobbin tube or coil core disposed therein is thus prevented. The spring plunger yields in reverse direction the instant the new bobbin tube or coil core presses against the feeler or sensing member which determines the presence of an old bobbin tube or coil core or presses against the old bobbin tube or coil core per se.

The advantages attained with the invention of the instant application are especially that individual stocking of the work stations of a textile machine with empty or unwound bobbin tubes or coil cores can be dispensed with since a bobbin or coil exchanger which carries with it a tube or core magazine according to the invention receives a sufficiently large supply of tubes or cores. Monitoring of the work stations with respect to the supplies therefore and the complex and time-consuming replenishing of the tube or core supplies at the individual work stations are also eliminated thereby. Only a central replenishing supply is thereby provided at each textile machine, from which the bobbin or coil exchanger takes its own supply fully automatically.

The invention of the instant application affords the further advantage that bobbins or coils of varying dimensions can be used in the textile machine without requiring changes or resettings at the tube or core magazine or at the loading means.

Other features which are considered as characteristic for the invention are set forth in the appended claims.

Although the invention is illustrated and described herein as embodied in a magazine assembly for coil cores or tubes, it is nevertheless not intended to be limited to the details shown, since various modifications and structural changes may be made therein without departing from the spirit of the invention and within the scope and range of equivalents of the claims.

Figure 2:
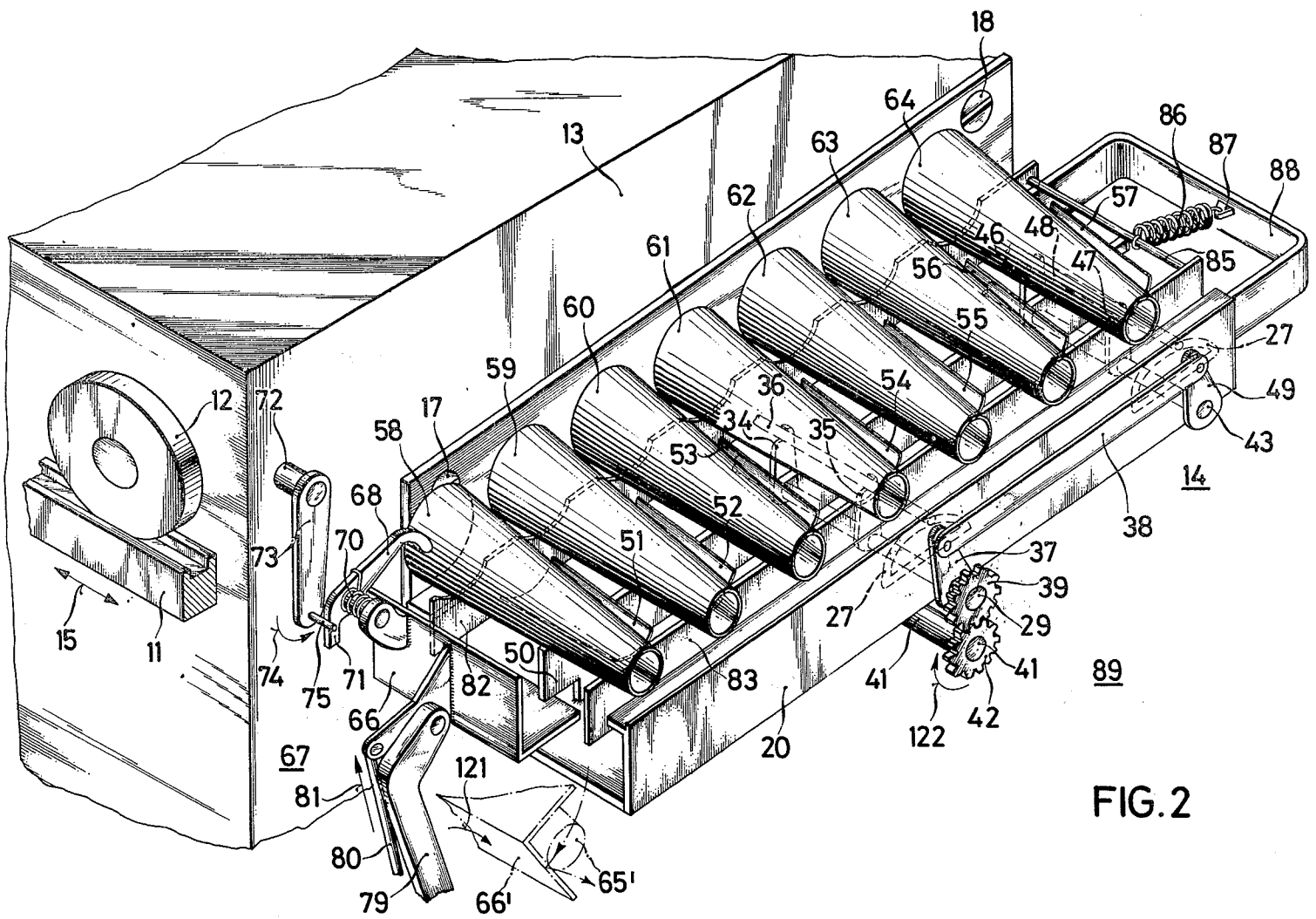
Figure 3:
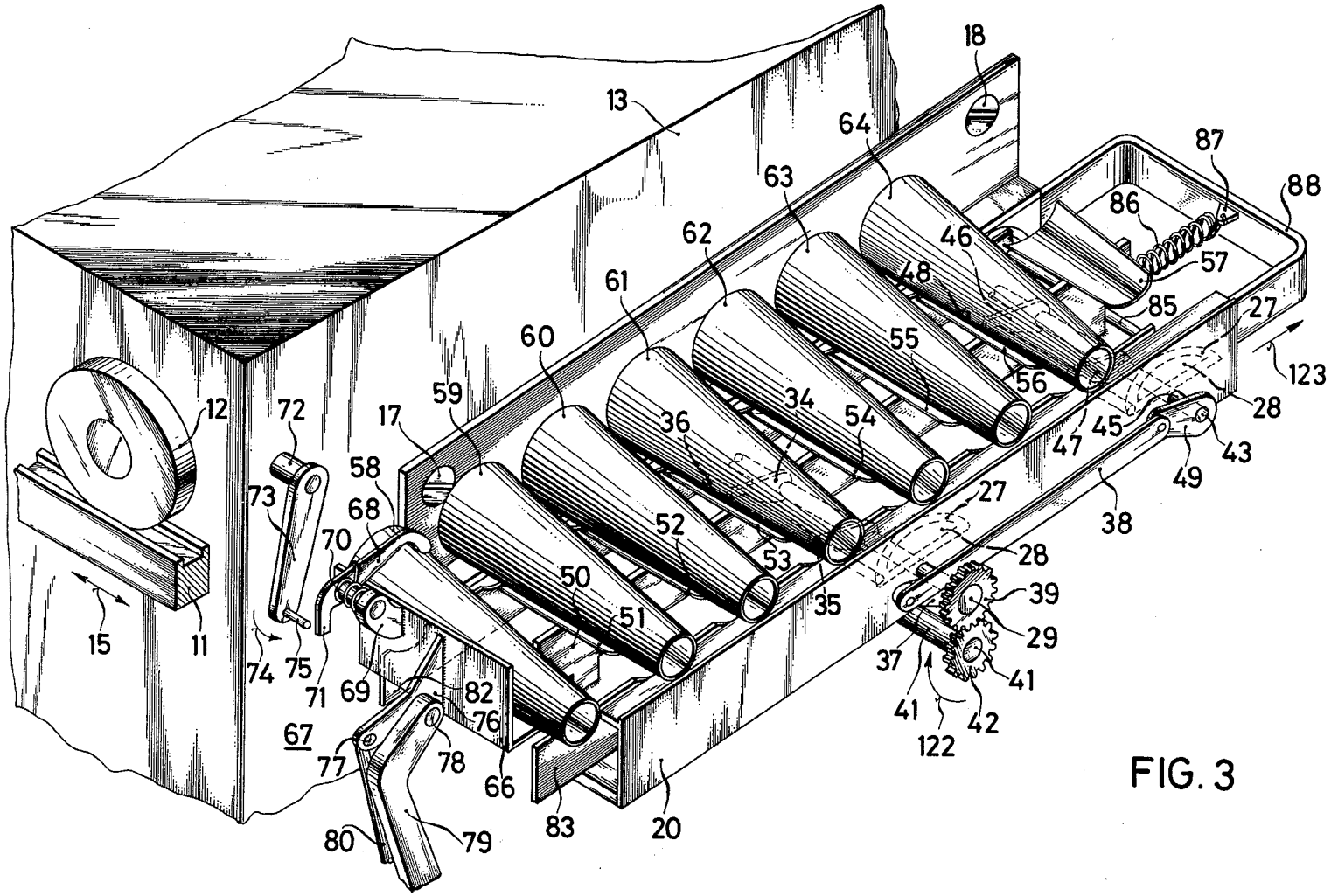
Figure 4:
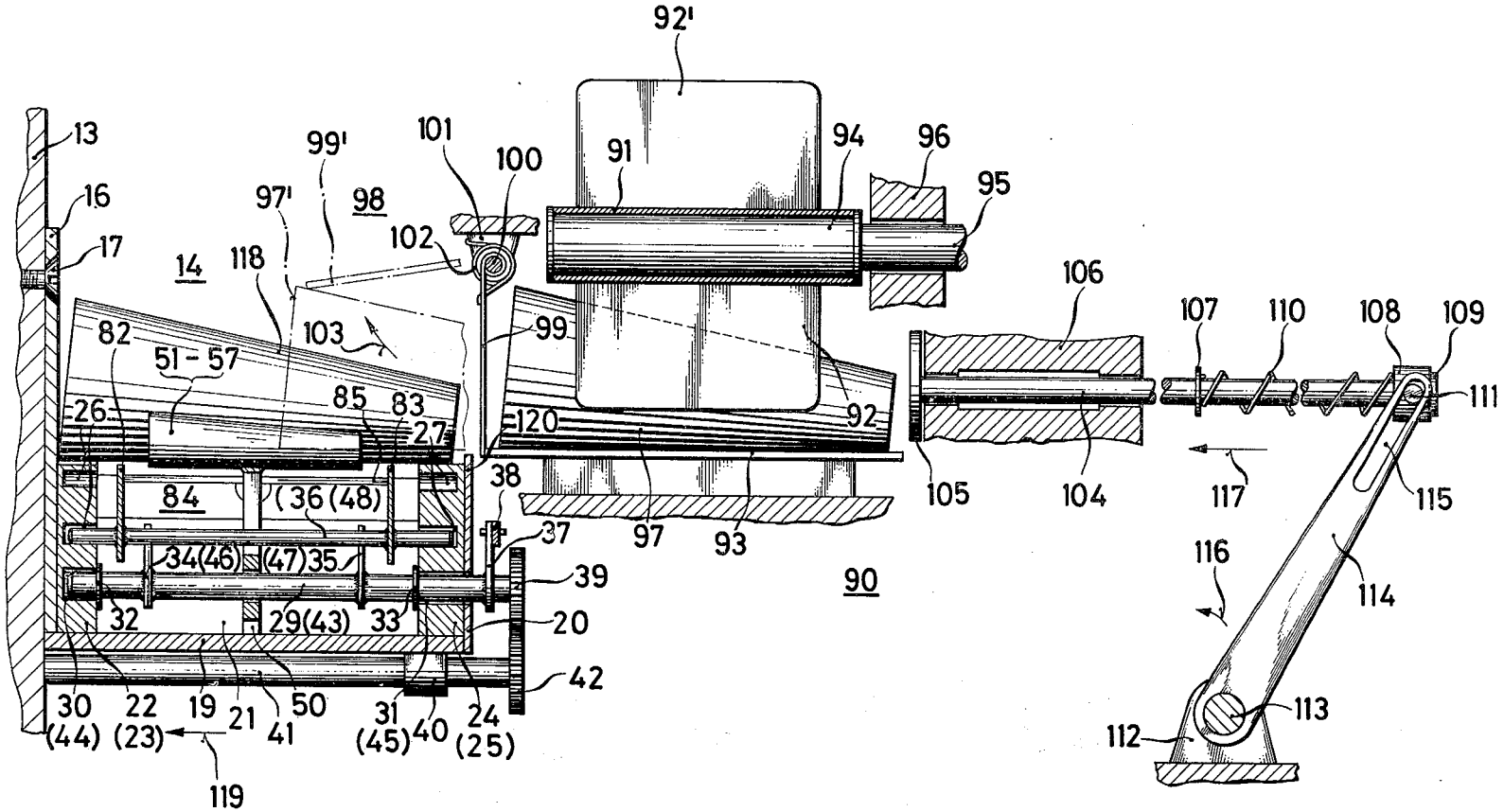

The construction and method of operation of the invention, however, together with additional objects and advantages thereof will be best understood from the following description of specific embodiments when read in connection with the accompanying drawings, in which:

FIGS. 1, 2 and 3 are similar perspective views of the feeding or advancing device of a coil core or tube magazine according to the invention showing the operation thereof in three different phases; and FIG. 4 is a cross-sectional view of the coil core or tube magazine of a travelling coil or bobbin exchanger according to the invention and of a loading or charging device located at the end of the travel path or track of the coil exchanger.

Referring now to the drawing and first, particularly to FIGS. 1 to 3 thereof, there is shown a coil or bobbin exchanger 13 which can travel on a rail or track 11 by means of a roller 12, and which is provided with a tube or coil core magazine 14. The bobbin or coil exchanger 13 is drivable in direction of the double-headed arrow 15 to the various work stations of a textile machine, not shown in detail, such as a yarn winding machine, for example.

The coil core or tube magazine 14 has a rear wall 16, which is fastened by screws 17 and 18 to the housing of the bobbin or coil exchanger 13. A base plate 19 connects the rear wall 16 to a front wall 20, so as to form a trough 21 (FIG. 4, for example). On the side of the rear wall 16 facing this trough 21, the rear wall 16 is provided with two inserts 22 and 23, and the front wall 20 has two similar inserts 24 and 25. All four inserts 22 to 25 have, on the side facing the trough 21, a respective slot 26 or 27 in the form of a closed linear curve surrounding the area of a circular segment 28. The circular arc points upwardly.

A shaft 29 is mounted in a bore 30 formed in the insert 22 and in a bore 31 formed in the insert 24. The shaft 29 is secured against axial displacement by securing rings 32 and 33 (FIG. 4). Two levers 34 and 35 (FIG. 2) provided with stepped or offset projections or nose-pieces are fastened to the shaft 29, the projections of the levers 34 and 35 engage behind a rod 36, which is displaceably mounted in the slots 26 and 27 formed, respectively, in the inserts 22 and 24.

The shaft 29 carries a further lever 37, to which a push rod 38 is articulatingly connected or linked. At the end of the shaft 29, a gear 39 is mounted.

A shaft 41, which is supported in the housing of the bobbin or coil exchanger 13 and in a bearing block 40, carries a gear 42 which meshes with the gear 39. The shaft 29 is rotatable by means of the gears 39 and 42 through the shaft 41.

A further shaft 43 is mounted in a bore 44 formed in the insert 23 and in a bore 45 formed in the insert 25. Two levers 46 and 47 are fastened to the shaft 43 and are provided with stepped or offset projections or nose-pieces which engage behind a rod 43 that is displaceably mounted in the slots 26 and 27 formed in the respective inserts 23 and 25. The shaft 43 carries a further lever 49, which is linked or articulatingly connected to the push rod 38.

In longitudinal direction of the tube or coil core magazine 14, a trough strip 50 is centrally fastened to the bottom plate 19 and is provided with notches or cutouts for the shafts 29 and 43 and the rods 36 and 48 and carries seven identical, upwardly open trough-shaped tube or coil-core holders 51 to 57. The tube or core holders 51 to 57 are fitted or matched in conical shell form to the shape of conical bobbin tubes or coil cores 58 to 64, which are disposed in the tube or coil core holders 51 to 57.

According to FIG. 1, a further conical coil core or bobbin tube 65 is disposed in an angle-shaped coil core or tube carrier 66 of a coil core removing device 67. The coil core removing device 67 has a coil core or tube gripper 68 which is articulatingly fastened to a crosstie rod or traverse 69 of the the coil core carrier 66. A wound coil spring 70 is biased so that the coil core or tube gripper 68 engages and grips the conical bobbin tube or coil core 65 from above and firmly holds it in the coil core carrier 66. The coil core gripper 68 has a lever 71. A lever 73 fastened to the shaft 72 can be swung, by means of a non-illustrated control cam of the coil exchanger 13, in direction of the arrow 74 until a pin 75 fastened to the free end of the lever 73 presses against the lever 71, the coil core or tube gripper 68 being opened in this process against the biasing force of the wound coil spring 70.

The coil core carrier 66 is provided with a lever 76 which has articulating connections or joints 77 and 78 provided thereon. The coil core carrier 66 is connected by the articulating joint 78 to an operating lever 79, which is controllable by the non-illustrated control cam of the coil core exchanger 13, and by means of which the coil core 65 can be removed and fed to a non-illustrated winding device for further processing. For this purpose, the coil core carrier 66 must first be swung downwardly out of the way while the operating lever 79 remains stationary, which is accomplished by shifting or displacing an actuating rod 80 in direction of the arrow 81.

The rods 36 and 48 are welded to two strips or cross-pieces 82 and 83 and form, in this manner, a feeding device 84. The feeding device 84 carries, at the rear end thereof a cross-bar 85 to which one end of a coiled tension spring 86 is fastened, the other end of the spring 86 being hooked into and suspended from a spring eye 87 of a bracket 88. The bracket 88 is rigidly connected to the rear wall 16 and the front wall 20.

The cross-pieces 82 and 83 are formed with half-round cutouts or notches in the upper edges thereof, as viewed in FIG. 1, for example, of the drawing, the cutouts being located in the spaces between the coil core or tube holders 51 to 57 and serve to receive the conical bobbin tubes or coil cores 58 to 64 during the feed or forward advance thereof.

The inserts 22 to 25 and the shafts 29, 41 and 43 with all the parts fastened thereto form a stepping mechanism 89. Actuation of the shaft 41 is effected by the non-illustrated control mechanism of the coil core or bobbin exchanger 13.

As is shown in FIG. 4, a loading device 90 is located at the end of the travel path or track of the bobbin or coil exchanger 13. The loading device 90 has an endless conveyor belt 91. The conveyor belt 91 carries a multiplicity of blades 92 and 92', which are disposed at the same spacing from one another as are the coil core or tube holders 51 to 57 of the coil core magazine 14.

The conveyor belt 91 takes individual conical coil cores or bobbin tubes from a non-illustrated very large supply thereof so that a respective conical coil core or bobbin tube is disposed on the table 93 between the blades 92, 92' of the conveyor belt 91. When the conveyor belt 91 is stationary, a respective bobbin tube or coil core is located in front of each coil core tube holder 51 to 57 of the coil core magazine 14.

The conveyor belt 91 is guided by belt rolls, of which only the belt roll 94 is visible in FIG. 4, the shaft 95 of the belt roll 94 being rotatably supported in a sliding bearing 96. When the conveyor belt 91 is stationary, a device for determining the extent of fullness of the coil core or tube magazine 14 is disposed in front of each conical coil core or bobbin tube lying on the table 93. In FIG. 4, only the coil core or bobbin tube 97 and the device 98 are visible. The device 98 has a flap 99 which is pivotally mounted on a pivot pin 100. The pivot pin 100 is fastened to a stationary crosstie rod 101. A wound coil spring 102 is looped around the pivot pin 100 and so pretensioned that, in the rest position, the free end of the flap 99 engages the table 93. The flap 99 can be swung in the direction of the arrow 103 against the biasing force of the wound coil spring 102.

A plunger 104, which carries a pressure plate 105 at one end thereof, is mounted so as to be displaceable in axial direction thereof within a stationary sliding bearing 106 in front of the conical coil core or bobbin tube 97. The plunger 104 is formed with a collar 107 and has at the other end thereof a crosshead (or guide block) 108 which is displaceable between the collar 107 and an end plate 109. A compression spring 110 is disposed between the collar 107 and the crosshead 108. The crosshead 108 carries a pin 111.

A stationary crosstie rod or traverse 112 carries a shaft 113, to which a lever 114 is fastened. At the end of the lever 114 a coulisse 115 is provided which serves as a guide for the pin 111 of the crosshead 108. When the lever 114 is swung in the direction of the arrow 116, the plunger 104 is displaced by means of the coulisse guide 115 in direction of the arrow 117. If the pressure plate 105 encounters increased resistance in the process, the displacement of the plunger 104 ceases. Simultaneously the force of the compression spring 110 is overcome exceeded and only the crosshead 108 is displaced in the direction of the arrow 117.

Although only the plunger 104 is visible in FIG. 4 of the drawing, similar plungers with similar actuating devices are disposed in front of each conical coil core or bobbin tube lying on the table 93. Since the coil core magazine 14 has seven coil core or tube holders 51 to 57 in the illustrated embodiment, seven identical plungers are also provided in the loading device 90.

Referring to FIG. 4 it is assumed that the coil or bobbin exchanger 13 has arrived at the end of the travel path or track thereof at a location at which the loading device 90 is disposed. The conveyor belt 91 of the loading device 90 is stationary.

Seven conical coil cores or bobbin tubes, of which only the coil core 97 is visible, are disposed on the table 93 between the blades 92 of the conveyor belt 91. The coil cores or bobbin tubes are disposed extending exactly in axial direction of the coil cores or tube holders 51 to 57 of the coil core magazine 14 of the coil exchange 13.

By means of a non illustrated control device of conventional construction, the shaft 113 of the loading device 90 is then rotated so that the lever 114 is swung in direction of the arrow 116. Accordingly, the plunger 104 is displaced in direction of the arrow 117. By means of the pressure plate 105, the plunger 104 endeavors to slide the coil core or bobbin tube 97 onto the tube holder 51. This is unable to be effected, however, because another conical coil core or bobbin tube 118 remains yet on the coil core holder 51.

Initially, the device 98 for determining the state or extent of fullness of the coil core magazine 14 is actuated. The plunger 104 can slide the bobbin tube or coil core 97 forward only so far that the flap 99 comes to rest against the smaller cone end of the coil core or bobbin tube 118. A relatively slight deflection of the flap 99 indicates or signals that the coil core holder 51 is full. Since the lever 114 completes the displacement thereof, only the crosshead 108 is displaced in the further displacement phase against the biasing force of the compression spring 110, because the flap 99 holds the coil core or bobbin tube 97 back. Upon the return of the lever 114 to the starting or neutral position thereof shown in FIG. 4, the flap 99 is pivoted under the biasing action of the coil spring 102 against the direction of the arrow 103, until the free end of the flap engages the table 93, the conical coil core or bobbin tube 97 being again slid back entirely onto the table 93 in the process.

If, on the other hand, the tube or coil core holder 51 contains no coil core, then the plunger 104 can slide the coil core 97 onto the coil core holder 51. The instant the coil core 97, as it is being inserted, reaches the position 97', the flap 99 will also have been swung fully outwardly and will have reached the position 99'. After the departure of the coil core exchanger 13 in direction of the arrow 119, the flap 99 again comes into engagement with the table 93. The flap 99 cannot then tightly hold the coil core lying on the coil core holder 51 and let it slide off again, because the protruding edge 120 of the front wall 20 of the coil core magazine 13 prevents this.

Since the other coil core holders also of the coil magazine 14 are filled in the same manner only if a demand for the coil cores arises, trouble due to overfilling, telescoping of the conical coil cores on the coil core holders or ejection of coil cores is reliably prevented.

After the tube or coil core magazine 14 has been filled, the coil exchanger 13 can become operative upon demand at any work station of the textile machine. According to FIG. 1, the tube or coil core carrier 66 of the tube removing device 67 already contains a conical coil core or bobbin tube. If a new coil core or bobbin tube is to be fed to the non-illustrated work station, the actuating arm or rod 80 is moved initially in direction of the arrow 81. The coil core carrier 66 accordingly swings into the position 66' thereof shown in phantom in FIG. 2. Simultaneously, the coil core 65 of FIG. 1 is swung into the position 65' thereof shown in phantom in FIG. 2. The actuating lever 79 can then be swung, unimpeded by the coil core magazine 14, in direction of the arrow 121, the coil core 65 being fed to the respective work station of the textile machine. Thereafter, the coil core carrier 66 is again brought into the normal position thereof shown in solid lines in FIG. 2. The instant this occurs, the stepping mechanism 89 goes into action. The shaft 41 is accordingly turned in direction of the arrow 122. This results in a counter clockwise rotary movement of the levers 37 and 49, the levers 34 and 35 consequently engaging the bar 36, and the levers 46 and 47 the bar 48, and while simultaneously lifting the bars 36 and 48, moving them toward the left-hand side, as viewed in FIGS. 1 to 3, in direction toward the the coil core removing device 67 in a circular path determined by the shape and disposition of the slots 26 and 27 formed in the inserts 22 to 25.

It is evident from FIG. 2 that the rods 36 and 48, in the phase of operation of the coil core magazine of the invention illustrated therein, have already reached the highest point of the circular path mentioned hereinbefore. Since the strips 82 and 83 also follow the movement of the rods 36 and 48, all the conical coil cores or bobbin tubes of the coil core magazine have already been lifted out of the coil core holders thereof in the illustrated operating phase of FIG. 2 and have been mounted in the half-round i.e. semicircular, cutouts in the strips 82 and 83.

In the operational phase of the coil core magazine illustrated in FIG. 3, the rods 36 and 48 have already traversed the circular path determined by the shape of the slots 26 and 27. The strips 82 and 83 have surrendered the coil cores or bobbin tubes again. Thereby, all the coil cores or bobbin tubes have advanced by one coil coreholder division in direction toward the coil core removing device 67, so that the coil core 58 is now disposed on the coil core carrier 66, the coil core 59 on the coil core holder 51, the coil core 60 on the coil core holder 52, the coil core 61 on the coil core holder 53, the coil core 62 on the coil core holder 54, the coil core 63 on the coil core holder 55 and the coil core 64 on the coil core holder 56. The coil core holder 57 no longer carries a coil core. During this period, the tension spring 86 has become tensioned.

The instant the position of the strips 82 and 83 illustrated in FIG. 3 is attained, the shaft 41 is rotated in a direction opposite that indicated by the arrow 122 i.e. counterclockwise as viewed in FIG. 3. The levers 34, 35, 46 and 47 accordingly swing back in clockwise direction, as viewed in FIG. 3 into the starting position thereof. Simultaneously, the strips 82 and 83 are withdrawn in direction of the arrow 123 by the tension spring 86. The rods 36 and 48 no longer follow the circular arc, however, but due to the weight of the strips 82 and 83, return to the starting position thereof shown in FIG. 1 in the rectilinear guide slots.

As is readily apparent from FIG. 2 of the drawing, the insertion of the bobbin tube or coil core 58 into the coil core carrier 66 is facilitated by the fact that the lever 73 is moved by means of the shaft 72 in direction of the arrow 74, the pin 75 accordingly pressing against the lever 71, so that the coil core gripper 68 is momentarily or temporarily opened.

The aforedescribed operational steps can be repeated as often as coil cores or bobbin tubes remain in the tube coil core magazine. The magazine can be replenished to any desired condition of fullness. The control of the operations is advantageously effected completely automatically, for example by a cam control provided in the interior of the bobbin or coil exchanger 13.

As aforementioned, the invention of the instant application is not limited to the illustrated and aforedescribed embodiment. Other embodiments are conceivable also within the scope of the claims.

The bobbin tubes or coil cores that are used may already have a small beginning winding. The tube or coil core holders 51 to 57 may also have the shape of a cylindrical shell in case cylindrical and conical coil cores or bobbin tubes are to be used selectively.

There are claimed:

1. Coil core magazine assembly for conical or cylindrical coil cores disposed mutually adjacent one another, comprising a traveling coil exchanger means movable from work station to work station of a textile machine and carrying a coil core magazine, means positioned adjacent the path of travel of said exchanger means for loading said magazine with coil cores, and means for removing coil cores from said magazine for subsequent winding, said magazine having a plurality of axially parallel coil core holders disposed in a given plane, said loading means comprising means for supporting said coil cores, means for aligning said plurality of coil cores on said supporting means with said plurality of coil core holders, and means for simultaneously axially sliding a plurality of said coil cores from said supporting means directly sideways onto said plurality of coil core holders, said magazine having a coil core feeding device operatively connected to said coil core holders for feeding the coil cores loaded in said coil core holders to said coil core removing means in a direction transverse to the axial direction of the coil cores.

2. Coil core magazine assembly according to claim 1 wherein said feeding device comprises a stepping mechanism including means for lifting the coil cores out of their respective coil core holders and simultaneously transporting all of the coil cores, in direction toward said coil core removing means through a division corresponding to one of the axially parallel coil core holders disposed in said given plane and means for lowering the lifted and transported coil cores into said coil core removing means and said coil core holders, respectively.

3. Coil core magazine assembly according to claim 1 wherein said coil core removing means comprises a coil core carrier swingable away from said coil core holders, and coil core gripper means for securing the respective coil core disposed in said coil core carrier from falling out of said coil core carrier.

4. Coil core magazine assembly according to claim 1 wherein said coil core loading means further comprises devices for determining the condition of fullness of said coil core magazine and for loading coil cores into only those coil holders that are vacant of any coil cores.

5. Coil core magazine assembly according to claim 1 wherein said coil core sliding means comprises plungers sprung in axial direction thereof for feeding the coil cores into said coil core magazine in axial direction of the coil cores.

* * * * *

UNITED STATES PATENT OFFICE

CERTIFICATE OF CORRECTION

PATENT NO. : 4,139,108

DATED : February 13, 1979

INVENTOR(S) : HEINZ KAMP and HANS RAASCH

It is certified that error appears in the above-identified patent and that said Letters Patent are hereby corrected as shown below:

In the heading to the printed specification, line 9,

"Appl. No.: 858,281", should read

--Appl. No.: 855,281--.

Signed and Sealed this

*Seventeenth* Day of *June 1980*

[SEAL]

*Attest:*

SIDNEY A. DIAMOND

*Attesting Officer*

*Commissioner of Patents and Trademarks*